US009096821B1

(12) United States Patent
Hope et al.

(10) Patent No.: US 9,096,821 B1
(45) Date of Patent: Aug. 4, 2015

(54) PRELOADED DUAL PURPOSE CLEANING AND SANITIZING WIPE

(71) Applicant: The Clorox Company, Oakland, CA (US)

(72) Inventors: Janiece Hope, Pleasanton, CA (US); Nancy A. Falk, Pleasanton, CA (US); Wenyu Zhang, Pleasanton, CA (US); Jared Heymann, Pleasanton, CA (US); Mona Marie Knock, Pleasanton, CA (US); Mike Kinsinger, Northampton, MA (US); Bernard Hill, Pleasanton, CA (US); Vidya Ananth, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 14/449,021

(22) Filed: Jul. 31, 2014

(51) Int. Cl.

| | |
|---|---|
| ***C11D 1/37*** | (2006.01) |
| ***C11D 3/48*** | (2006.01) |
| ***C11D 17/04*** | (2006.01) |
| ***C11D 7/32*** | (2006.01) |
| ***C11D 7/50*** | (2006.01) |

(52) U.S. Cl.
CPC ..... *C11D 17/046* (2013.01); *C11D 7/3209* (2013.01); *C11D 7/5022* (2013.01)

(58) Field of Classification Search
CPC ..... C11D 17/049; C11D 1/37; C11D 3/2006; C11D 7/263; C11D 3/48
See application file for complete search history.

(56) References Cited

U.S. PATENT DOCUMENTS

| | | | | |
|---|---|---|---|---|
| 2,684,924 | A | 7/1954 | Swain et al. | |
| 2,990,425 | A | 6/1961 | Senior | |
| 3,468,898 | A | 9/1969 | Cutler et al. | |
| 4,022,834 | A | 5/1977 | Gunderson | |
| 4,053,636 | A | 10/1977 | Eustis, III et al. | |
| 4,198,392 | A | 4/1980 | Juneja | |
| 4,463,045 | A | 7/1984 | Ahr et al. | |
| 4,540,505 | A * | 9/1985 | Frazier | 510/384 |
| 5,145,604 | A | 9/1992 | Neumiller | |
| 5,292,581 | A | 3/1994 | Viazmensky et al. | |
| 5,342,534 | A | 8/1994 | Skrobala | |
| 5,444,094 | A | 8/1995 | Malik et al. | |
| 5,454,984 | A | 10/1995 | Graubart et al. | |
| 5,522,942 | A | 6/1996 | Graubart et al. | |
| 5,686,015 | A | 11/1997 | Willey | |
| 5,798,329 | A | 8/1998 | Taylor et al. | |
| 5,814,591 | A * | 9/1998 | Mills et al. | 510/238 |
| 5,908,854 | A | 6/1999 | McCue et al. | |
| 5,922,665 | A | 7/1999 | Liu | |
| 5,948,743 | A * | 9/1999 | Fonsny et al. | 510/280 |
| 6,017,869 | A * | 1/2000 | Lu et al. | 510/384 |
| 6,080,706 | A * | 6/2000 | Blanvalet et al. | 510/108 |
| 6,090,768 | A | 7/2000 | Delaney et al. | |
| 6,110,295 | A * | 8/2000 | Lu et al. | 134/42 |
| 6,121,224 | A * | 9/2000 | Fonsny et al. | 510/384 |
| 6,130,197 | A | 10/2000 | Bedford et al. | |
| 6,143,244 | A | 11/2000 | Xia et al. | |
| 6,143,281 | A | 11/2000 | Alexander et al. | |
| 6,153,568 | A | 11/2000 | McCanna et al. | |
| 6,187,737 | B1 | 2/2001 | Geke et al. | |
| 6,277,805 | B1 | 8/2001 | Kupneski | |
| 6,323,171 | B1 * | 11/2001 | Fonsny et al. | 510/384 |
| 6,339,057 | B1 | 1/2002 | Knox et al. | |
| 6,342,474 | B1 | 1/2002 | Kerobo et al. | |
| 6,358,900 | B1 | 3/2002 | Wigley et al. | |
| 6,376,455 | B1 | 4/2002 | Friedli et al. | |
| 6,387,866 | B1 * | 5/2002 | Mondin et al. | 510/384 |
| 6,387,871 | B2 | 5/2002 | Faber | |
| 6,429,183 | B1 * | 8/2002 | Leonard et al. | 510/438 |
| 6,462,014 | B1 | 10/2002 | Johnson et al. | |
| 6,583,104 | B1 | 6/2003 | Christensen et al. | |
| 6,596,681 | B1 | 7/2003 | Mahieu | |
| 6,680,264 | B2 | 1/2004 | Julemont | |
| 6,693,070 | B1 | 2/2004 | Cheung et al. | |
| 6,737,068 | B2 | 5/2004 | Durden | |
| 6,814,088 | B2 | 11/2004 | Barnabas | |
| 6,831,050 | B2 | 12/2004 | Murch | |
| 6,844,308 | B1 * | 1/2005 | Dastbaz et al. | 510/438 |
| 6,849,589 | B2 | 2/2005 | Liu | |
| 6,936,580 | B2 | 8/2005 | Sherry | |
| 7,071,155 | B2 | 7/2006 | Griese et al. | |
| 7,214,651 | B2 | 5/2007 | Mohr et al. | |
| 7,348,303 | B2 | 3/2008 | Gallotti et al. | |
| 7,396,808 | B1 | 7/2008 | Hood | |
| 7,511,006 | B2 | 3/2009 | Shimmin | |
| 7,530,361 | B2 | 5/2009 | Killeen et al. | |
| 7,550,416 | B2 | 6/2009 | Woo | |
| 8,173,146 | B2 | 5/2012 | Leroy | |
| 8,252,819 | B2 | 8/2012 | Felder | |
| 8,278,260 | B2 | 10/2012 | Saint Victor | |
| 8,283,304 | B2 | 10/2012 | Saint Victor | |
| 2003/0073600 | A1 * | 4/2003 | Avery et al. | 510/382 |

(Continued)

FOREIGN PATENT DOCUMENTS

| | | | |
|---|---|---|---|
| CA | 2132274 | A1 | 5/1995 |
| DE | 2212259 | A1 | 10/1972 |

(Continued)

OTHER PUBLICATIONS

International Search Report, mailed Jul. 29, 2013, from counterpart PCT/US13/48586; Jun. 28, 2013.

*Primary Examiner* — Charles Boyer
(74) *Attorney, Agent, or Firm* — Erin Collins

(57) ABSTRACT

The invention relates to preloaded cleaning and sanitizing wipes comprising a nonwoven substrate, and a cleaning formulation loaded onto or within the nonwoven substrate. The cleaning composition may include about 0.001% to about 10% by weight of an antimicrobial compound comprising a quaternary ammonium compound, less than about 4% by weight of an alcohol solvent containing a single hydroxyl group, a preservative, about 0.05% to about 10% by weight of a glycol solvent (e.g., preferably a glycol ether solvent), about 0.05% to about 10% of one or more surfactants, and water. The composition may have a pH from about 4 to about 8.

19 Claims, 3 Drawing Sheets

(56) References Cited

U.S. PATENT DOCUMENTS

| | | | | |
|---|---|---|---|---|
| 2003/0228991 | A1 | 12/2003 | Johnson et al. | |
| 2004/0209792 | A1* | 10/2004 | Mitra et al. | 510/438 |
| 2004/0224867 | A1* | 11/2004 | Colurciello et al. | 510/238 |
| 2005/0026802 | A1 | 2/2005 | Kilkenny | |
| 2005/0148655 | A1 | 7/2005 | Manzer | |
| 2005/0215458 | A1 | 9/2005 | Lalum | |
| 2005/0227898 | A1 | 10/2005 | Leskowicz et al. | |
| 2006/0016785 | A1 | 1/2006 | Egbe et al. | |
| 2006/0052264 | A1 | 3/2006 | Lu | |
| 2006/0172912 | A1 | 8/2006 | Burt et al. | |
| 2006/0234899 | A1* | 10/2006 | Nekmard et al. | 510/439 |
| 2007/0185004 | A1* | 8/2007 | Kilkenny et al. | 510/475 |
| 2008/0261856 | A1* | 10/2008 | Nakagawa et al. | 510/421 |
| 2008/0287331 | A1 | 11/2008 | Lin et al. | |
| 2010/0101605 | A1 | 4/2010 | Saint Victor | |
| 2010/0249245 | A1 | 9/2010 | Whiteley et al. | |
| 2010/0323895 | A1 | 12/2010 | Garner | |
| 2011/0098206 | A1 | 4/2011 | Lynch et al. | |
| 2011/0219312 | A1 | 9/2011 | Kim et al. | |
| 2011/0311600 | A1* | 12/2011 | Polzin et al. | 424/409 |
| 2012/0034287 | A1* | 2/2012 | Napolitano et al. | 424/409 |

FOREIGN PATENT DOCUMENTS

| | | | |
|---|---|---|---|
| DE | 2627548 | A1 | 1/1977 |
| DE | 1964196 | B2 | 2/1977 |
| EP | 0024031 | B2 | 5/1987 |
| WO | 2007073877 | A1 | 7/2007 |
| WO | 2008008063 | A1 | 1/2008 |
| WO | 2010101864 | A1 | 9/2010 |
| WO | 2011064554 | A1 | 6/2011 |

* cited by examiner

PRELOADED DUAL PURPOSE CLEANING AND SANITIZING WIPE

BACKGROUND OF THE INVENTION

1. The Field of the Invention

The present invention relates to cleaning and sanitizing formulations, particularly such as those impregnated on or within a wipe or similar substrate.

2. Description of Related Art

Cleaning product formulations with antimicrobial sanitizing abilities typically include high concentrations of lower alcohols (e.g., ethanol), and/or employ a quaternary ammonium compound as an antimicrobial agent. Reduction of the surface tension exhibited by such formulations is often directly related to the effectiveness of the wetting of solid surfaces and hence the antimicrobial processes, and can be manipulated through the use of mixtures of surfactants, as is known in the art. Care must be taken in selection of any surfactants, depending on the intended use. For example, where such a formulation loaded within a cleaning wipe is used for hard surface cleaning (e.g., of mirrors, tiles, countertops, etc.), it is undesirable for the composition to leave behind a film residue or exhibit "streaking" upon drying. On the other hand, where a sanitizing wipe is intended for sanitizing the skin of a person (e.g., for sanitizing hands), this may be less of a concern. Similarly, where a formulation may be intended for application to hands or other skin tissue, it may be desirable to include emollient components capable of hydrating and aiding the skin in retaining moisture. Such components are often incompatible for inclusion in a formulation for hard surface cleaning, as such components would be expected to cause streaking and leave a residue.

Thus, while one formulation may be suitable for use in hard surface sanitizing, it may not be particularly well suited for use in sanitizing hands or other skin. It would be an advantage in the art to provide a formulation which could provide dual uses, providing benefits of an emollient to the skin, while at the same time minimizing streaking and similar surface residues.

BRIEF SUMMARY OF THE INVENTION

In an embodiment, the present invention is directed to preloaded cleaning and sanitizing wipes comprising a nonwoven substrate, and a cleaning composition loaded onto or within the nonwoven substrate. The cleaning composition may comprise from about 0.001% to about 5% by weight of a quaternary ammonium compound, less than about 4% by weight of an alcohol solvent containing a single hydroxyl group (i.e., a mono-alcohol), from about 0.01% to about 10% by weight of a glycol solvent, about 0.01% to about 10% of one or more surfactants, a preservative, and water. The pH of the composition may be from about 4 to about 8, preferably about 4 to 6 and more preferably about 5 to 6. The glycol solvent may be selected from the group consisting of diethylene glycol, triethylene glycol, propylene glycol, tripropylene glycol, ethylene glycol monomethyl ether, ethylene glycol monoethyl ether, ethylene glycol monopropyl ether, ethylene glycol monobutyl ether, ethylene glycol monophenyl ether, ethylene glycol monobenzyl ether, diethylene glycol monomethyl ether, diethylene glycol monoethyl ether, diethylene glycol mono-n-butyl ether, diethylene glycol monohexyl ether, triethylene glycol monomethyl ether, triethylene glycol monoethyl ether, triethylene glycol monobutyl ether, ethylene glycol dimethyl ether, ethylene glycol diethyl ether, ethylene glycol dibutyl ether and any combinations or mixtures thereof.

In another embodiment, the present invention is directed to a cleaning and sanitizing wipe comprising a nonwoven substrate, and a cleaning composition loaded onto or within the nonwoven substrate. The cleaning composition includes about 0.01 to about 5% by weight of an antimicrobial compound comprising a quaternary ammonium compound, less than about 1% by weight of an alcohol solvent containing a single hydroxyl group, a preservative, about 0.5% to about 5% by weight of a glycol ether solvent, and water. The composition may be essentially free of any other antimicrobial compounds, other than the specifically included one or more quaternary ammonium compounds. In the event the quaternary ammonium compound is the only antimicrobial compound in the cleaning composition, the composition will most likely have a first preservative and a second preservative.

In another embodiment, the present invention is directed to a method of using a cleaning and sanitizing wipe to clean skin and a hard surface. The method may comprise the steps of providing a user a pre-loaded nonwoven substrate loaded with a cleaning composition comprising from about 0.05% to about 5% by weight of a quaternary ammonium compound, from about 0.05% to about 1% by weight of an alcohol solvent, a preservative, from about 0.05% to about 10% of one or more glycol solvents, and water. The method may further comprise contacting the skin with the pre-loaded substrate to sanitize the skin, allowing the sanitized area of the skin to dry, and wiping one or more hard surfaces with the pre-loaded substrate, Thus, the dual purpose wipe can be used to both sanitize skin and clean hard surfaces.

The inventors have advantageously discovered that the inclusion of specific glycol ether solvents, particularly diethylene glycol monoethyl ether (DEGEE) functions as an emollient on the skin, modifying the evaporation rate of the liquid, and aiding in hydration of the user's skin. Surprisingly, the glycol ether solvent further serves to mitigate and minimize the appearance of surface residue on hard surfaces, which is unexpected as such a glycol ether emollient component would be expected to increase streaking and surface residue on hard surfaces.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
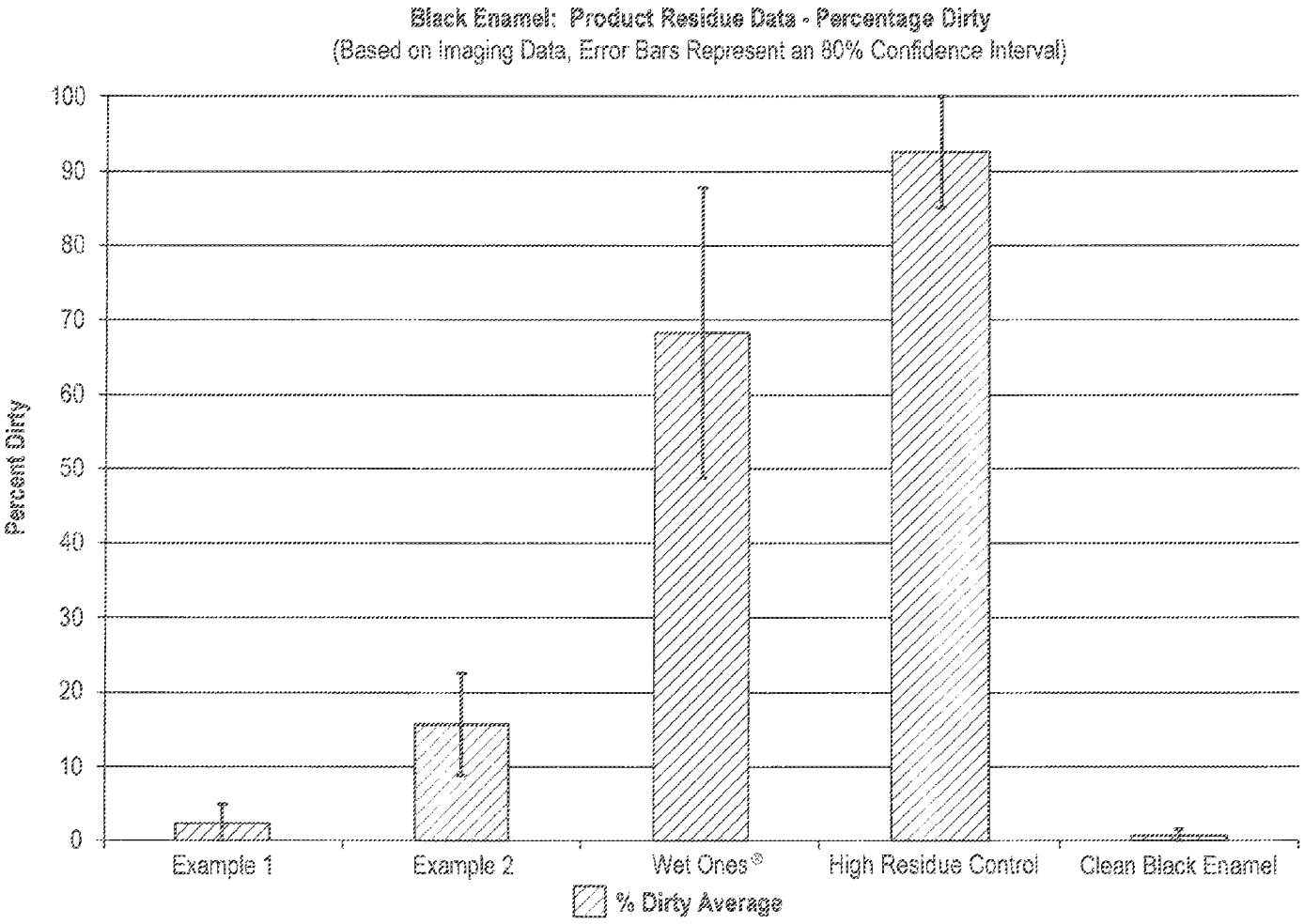
FIG. 1 is a bar chart showing overall residue and percent dirty scores for several formulations tested on black enamel tiles.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "surfactant" includes one, two or more surfactants.

As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant."

As used herein, the term "substrate" is intended to include any material that is used to clean an article or a surface. Examples of cleaning substrates include, but are not limited to nonwovens, e.g., a nonwoven wipe.

As used herein, the terms "nonwoven" or "nonwoven web" means a web having a structure of individual fibers or threads which are interlaid, but not in an identifiable manner as in a knitted web.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentages ("wt %'s") are in wt % (based on 100 weight % active) of the particular material present in the referenced composition, any remaining percentage typically being water or an aqueous carrier sufficient to account for 100% of the composition, unless otherwise noted. For very low weight percentages, the term "ppm" corresponding to parts per million on a weight/weight basis may be used, noting that 1.0 wt % corresponds to 10,000 ppm.

II. Introduction

It can be particularly difficult to provide emollient skin hydrating and soothing characteristics within a cleaning and sanitizing composition, while at the same time minimizing any tendency of the composition to leave a surface residue when used to wipe a hard surface, such tile or glass. The presently described formulations include a glycol (e.g., particularly preferred is a glycol ether) solvent that can serve as an emollient, providing skin hydrating and soothing characteristics to the sanitizing composition for use on hands or other skin. Surprisingly, in comparative testing, the inventors have further discovered that the compositions advantageously leave less surface residue and exhibit less of a tendency to streak when used on hard surfaces such as tile and glass as compared to various existing sanitizing formulations. This reduced surface residue is particularly pronounced where the glycol solvent includes a glycol ether solvent. Diethylene glycol monoethyl ether (DEGEE) is a particularly preferred glycol ether solvent having been shown to exhibit excellent results with respect to minimization of surface residue.

III. Exemplary Components of the Dual Purpose Formulations

A. Quaternary Ammonium Compounds

Quaternary ammonium compounds are a class of cationic surfactants that provide antimicrobial benefits. The present formulations may include one or more quarternary ammonium compounds. Examples of quaternary ammonium compounds include, but are not limited to, benzalkonium chloride, benzethonium chloride, methylbenzethonium chloride, cetalkonium chloride, cetylpyridinium chloride, cetrimonium, cetrimide, dofanium chloride, dodecyl dimethyl ammonium chloride, n-alkyl dimethyl benzyl ammonium chloride, cetyl trimethylammonium chloride pentyl trimethyl ammonium chloride, and combinations or mixtures thereof. The counterion may be a halogen other than chlorine, e.g., such as bromine or another halide. Exemplary quaternary ammonium bromides include, but are not limited to, tetraethylammonium bromide and domiphen bromide. Bromides that are analogous to the above mentioned chlorides may also be suitable for use. In some examples, counterions other than halogens may also be suitable for use (e.g., sulfate, methylsulfate, ethylsulfate, or toluene sulfonate). In one embodiment of the invention the preferred compounds include, but not limited to, benzalkonium chloride, benzethonium chloride, and methylbenzethonium chloride. Suitable exemplary quaternary ammonium compounds are available from Lonza under the tradename Lonzagard (e.g., Lonzagard benzethonium chloride). Additional exemplary quaternary ammonium compounds are available from Stepan Co. under the tradename BTC (e.g., BTC 1010, BTC 1210, BTC 818, BTC 8358).

Other suitable quaternary ammonium compounds that may be suitable include dialkyldimethyl ammonium salts, in which the alkyl groups each contain 4 to 12 carbon atoms such as dioctyldimethyl ammonium chloride. Other suitable quaternary ammonium compounds may have two quaternary ammonium groups connected by a short alkyl chain such as N-alkylpentamethyl propane diammonium chloride. In the above quaternary ammonium compounds the methyl substituents can be completely or partially replaced by other alkyl or aryl substituents such as ethyl, propyl, butyl, benzyl, and ethylbenzyl groups, for example octyldimethylbenzyl ammonium chloride and tetrabutylammonium chloride. The quaternary ammonium compound may typically be present within a range of about 0.001% to about 5%, about 0.05% to about 3%, 0.05% to about 0.5%, or about 0.1% to about 0.5% by weight.

B. Alcohol Solvent

The formulation may include a small fraction of an alcohol solvent containing a single hydroxyl group (i.e., a monoalcohol). Examples include short chain alcohols (e.g., including 1-4 carbon atoms), particularly ethanol, isopropanol, n-propanol, butanol, and mixtures or combinations thereof. Advantageously, the formulations do not include a large fraction of such an alcohol solvent. For example, while many sanitizing formulations rely on very high ethanol concentrations in order to achieve the desired antimicrobial effect (e.g., 40% or more ethanol), the present formulations include an alcohol solvent, if at all, in an amount of less than about 4% by weight. This is advantageous as short chain alcohols are relatively volatile, and formulations including relatively high concentrations of such components are believed to dry out the skin, which effect can be particularly exacerbated as a result of frequent use. For example, if present, such an alcohol component may be present at less than about 4% by weight (e.g., from about 0.05% to 4%), less than about 1% by weight (e.g., from about 0.05% to 1%), less than 0.75% by weight, or less than 0.5% by weight of the composition.

In an embodiment, the cleaning formulation may be essentially free of any other antimicrobial compounds, other than the one or more quaternary ammonium compounds and the preservative (e.g. antifungal compound). For example, it may include any monoalcohol components, if at all, at fractions of less than 1%. In addition, the formulation may be free of other antimicrobials, such as biguanides (e.g., chlorhexidine), triclosan, etc.

C. Glycol Solvents

The formulations advantageously include a glycol solvent. Such glycol solvent components serve to provide emollient benefits for when the formulations are used on the hands or other skin, helping to retain water within the user's skin. Examples of glycol solvents include, but are not limited to, diethylene glycol, triethylene glycol, propylene glycol, tripropylene glycol, and combinations or mixtures thereof. In an embodiment, the glycol solvent may include a glycol ether solvent. Examples of glycol ether solvents include, but are not limited to, ethylene glycol monomethyl ether, ethylene glycol monoethyl ether, ethylene glycol monopropyl ether, ethylene glycol monobutyl ether, ethylene glycol monophenyl ether, ethylene glycol monobenzyl ether, diethylene glycol monomethyl ether, diethylene glycol monoethyl ether, diethylene glycol mono-n-butyl ether, diethylene glycol monohexyl ether, triethylene glycol monomethyl ether, triethylene glycol monoethyl ether, triethylene glycol monobutyl ether, ethylene glycol dimethyl ether, ethylene glycol diethyl ether, ethylene glycol dibutyl ether and any combinations or mixtures thereof. The above described examples of glycol ethers are derived from ethylene (i.e., ethylene glycol ethers). Analogous propylene glycol ethers may also be suitable for use. Diethylene glycol ethers, particularly diethylene glycol monoethyl ether (DEGEE), have been shown to work particularly well.

The glycol solvent may typically be present within a range of about 0.001% to about 5%, 0.05% to about 10%, about 0.5% to about 5%, or 0.05% to about 2% by weight. Where a glycol ether solvent is preferably included, both a glycol solvent (e.g., propylene glycol) and glycol ether solvent (e.g., DEGEE) may be present. In such formulations, the glycol solvent (e.g., propylene glycol) may be present within the range described above, while the glycol ether may be present in a range of about 0.5% to about 10%, about 0.5% to about 2% by weight, or about 0.75% to about 1.5% by weight. The glycol ether may be present at a substantially higher concentration than the glycol solvent. For example, where the formulation includes both DEGEE and propylene glycol, the ratio of the glycol ether solvent (e.g., DEGEE) to the glycol solvent (e.g., propylene glycol) may be at least 5:1, at least 10:1, or at least 15:1.

The inventors have found that formulations that include a glycol ether solvent (e.g., diethylene glycol monoethyl ether) exhibit surprisingly low residue characteristics when applied onto hard surfaces, such as tile and glass. This is surprising, as while such a glycol ether solvent may perhaps be expected to provide emollient benefits to skin, and to decrease loss of water from the skin, one would typically expect emollient components to leave significant filmy, streaky residues on tile and glass surfaces. Unexpectedly, compositions including such a glycol ether component were found to exhibit much lower residue characteristics than an otherwise identical formulation, but without the glycol ether. Also surprisingly, the otherwise identical formulation, which included only a glycol solvent (e.g., propylene glycol) itself exhibited lower residue characteristics as compared to existing wipe formulations (e.g., such as WET ONES® Antibacterial Hand Wipes). These surprising results are described in more detail in the Examples section below.

D. Surfactants

The formulations according to the present invention may include one or more surfactants (e.g., other than the quaternary ammonium compound, which may technically be termed a cationic surfactant). Surfactants may be anionic surfactants, nonionic surfactants, amphoteric surfactants, cationic surfactants, zwitterionic surfactants, ampholytic surfactants, or mixtures thereof. Exemplary anionic surfactants include, but are not limited to, sulfates, sultanates, disulfonates, carboxylates, sulfosuccinates, isethionates, glutamates, and sarcosinates, and any combinations or mixtures thereof. Such surfactants may be alkyl or alkyl ether derivatives of such functional groups. More specific examples of such anionic surfactants include, but are not limited to sodium lauryl sulfate (SLS), ammonium lauryl sulfate, sodium laureth sulfate (SLES), ammonium laureth sulfate, sodium coco-sulfate, ammonium cocoyl isethionate, sodium cocoyl isethionate, disodium cocoyl glutamate, sodium lauryl glucose carboxylate, sodium dodecyl sulfate, sodium lauryl ether sulfate, sodium myreth sulfate and any combinations or mixtures thereof. Alkyl sulfonates, e.g., C6-C18 linear or branched alkyl sulfonates such as sodium octane sulfonate and sodium secondary alkane sulfonate, alkyl ethoxysulfates, fatty acids and fatty acid carboxylate salts (e.g., C6-C16 fatty acid soaps such as sodium laurate, sodium stearate, etc.), and alkyl amino acid derivatives may also be suitable.

Rhamnolipids bearing anionic charges may also be used, for example, in formulations emphasizing greater sustainability, since they are not derived from petroleum-based materials. An example of such a rhamnolipid is JBR 425, which is supplied as an aqueous solution with 25% actives, from Jenil Biosurfactant Co., LLC (Saukville, Wis., USA). Other examples may include sulfate derivatives of alkyl ethoxylate propoxylates, alky ethoxylate sulfates, alpha olefin sulfonates, C6-C16 acyl isethionates (e.g. sodium cocoyl isethionate), C6-C18 alkyl, aryl, or alkylaryl ether sulfates, C6-C18 alkyl, aryl, or alkylaryl ether methylsulfonates, C6-C18 alkyl, aryl, or alkylaryl ether carboxylates, sulfonated alkyldiphenyloxides (e.g. sodium dodecyldiphenyloxide disulfonate), and combinations thereof. Cognis Standapol ES-2K is an example of sodium laureth sulfate (SLES), an alkyl ether sulfate surfactant. Steol CS-230 (Stepan Co.) is an example of an alkyl ethoxysulfate. Biosoft S-101 (Stepan Co.) is an example of an alkylbenzene sulfonate surfactant. Sodium lauroyl sarcosinate and dioctyl sodium sulfosuccinate are examples of acyl sarcosinate and alkyl sulfosuccinate surfactants.

Amphoteric surfactants may also be employed. Examples include, but are not limited to, amine oxides, betaines, imidazoline derivatives, glycinates, propionates, amino propionic acids, and any combinational or mixtures thereof. More specific examples include C8-C18 alkyldimethyl amine oxides (e.g., octyldimethylamine oxide, lauryldimethylamine oxide, and cetyldimethylamine oxide), C4-C16 dialkylmethylamine oxides (e.g. didecylmethylamine oxide), C8-C18 alkyl morpholine oxide (e.g. laurylmorpholine oxide), tetra-alkyl diamine dioxides (e.g. tetramethyl hexanane diamine dioxide, lauryl trimethyl propane diamine dioxide), C8-C18 alkyl betaines (e.g. decylbetaine and cetylbetaine), C8-C18 alkyliminodipropionates (e.g. sodium lauryliminodipropionate), and combinations thereof. Lauryl dimethyl amine oxide (AMMONYX LO) and myristyl dimethyl amine oxide (AMMONYX MO) are examples of amphoteric surfactants, available from Stepan Co. Cocoamidopropyl betaine is an example of a betaine surfactant, available under the tradename DEHYTON PK 45 from BASF.

Examples of nonionic surfactants include, but are not limited to ethoxylates, propoxylates, glycosides, esters, amides, and any combinations or mixtures thereof. More specific examples may include poly alkoxylated (e.g. ethoxylated or propoxylated) C6-C22 linear or branched aliphatic primary or secondary alcohols. Block or random copolymers of C2-C6 linear or branched alkylene oxides may also be suitable nonionic surfactants. Capped nonionic surfactants in which the terminal hydroxyl group is replaced by halide; C1-C8 linear, branched or cyclic aliphatic ether; C1-C8 linear, branched or cyclic aliphatic ester; phenyl, benzyl or C1-C4 alkyl aryl ether; or phenyl, benzyl or C1-C4 alkyl aryl ester may also be used. Sorbitan esters and ethoxylated sorbitan esters may also be useful nonionic surfactants. Other suitable nonionic surfactants may include mono or polyalkoxylated amides of the formula $R^1CONR^2R^3$ and amines of the formula $R^1NR^2R^3$ wherein $R^1$ is a C5-C31 linear or branched alkyl group and $R^2$ and $R^3$ are C1-C4 alkyl, C1-C4 hydroxyalkyl, or alkoxylated with 1-3 moles of linear or branched alkylene oxides. Biosoft 91-6 (Stepan Co.) is an example of an alkyl ethoxylate (or alcohol ethoxylate) having a methylene chain length of C9 to C11 with an average of 6 moles of ethoxylation. In one embodiment of the invention, the composition may be essentially free of any nonionic surfactants. In a further embodiment of the invention, the composition may be essentially free of nonionic surfactants selected from the group consisting of: ethoxylated alcohol, propoxylated alcohol, ethylene oxide and propylene oxide alcohols (EO-PO surfactants), alkyl polyglycosides, fluorosurfactants and any combinations or mixtures thereof.

Alkylpolysaccharides that may be suitable for use herein are disclosed in U.S. Pat. No. 4,565,647 to Llenado, having a linear or branched alkyl, alkylphenyl, hydroxyalkyl, or hydroxyalkylphenyl group containing from 6 to 30 carbon atoms and a polysaccharide, e.g., a polyglycoside, hydrophilic group containing from 1.3 to 10 saccharide units. Suitable saccharides include, but are not limited to, glucosides, galactosides, lactosides, and fructosides. Alkylpolyglycosides may have the formula: $R^2O(CnH_{2n}O)_t(\text{glycosyl})_x$ wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 10.

Other nonionic, anionic, cationic, ampholytic, amphoteric and zwitterionic surfactants and mixtures thereof may be suitable for use. Combinations between classes of surfactants (e.g., inclusion of both an anionic and amphoteric surfactant) may be used. A typical listing of anionic, ampholytic and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Each of the above patents is incorporated by reference in its entirety.

Because of the addition of the quaternary amine cationic surfactant as an antimicrobial in the lotion composition, it is preferable for the majority of the balance of the surfactant package to be nonionic or amphoteric to maintain physical stability of the lotion. Ideally the anionic surfactant should be less than 25%, to less than 10%, to less than 5% of the total surfactant added.

In an additional embodiment, the composition is essentially free of anionic surfactant.

The surfactants combined concentration may typically be within a range of about 0.05% to about 10%, 0.1% to about 1%, 0.1% to about 0.5%, or 0.1% to about 0.35% by weight.

E. Water

The vast majority of the dual purpose formulation may comprise water. For example, the water content may typically range from 50% to 99% of the formulation by weight. In an embodiment, water may comprise at least about 90%, at least 95%, or at least 97% of the formulation by weight. In one embodiment, soft or distilled water is preferred to minimize effects of trace ions on stability and residue.

F. Additional Adjuvants

The dual purpose formulation may also comprise various other adjuvants, such as fragrances, dyes, solvents, lubricants, humectants, pH adjusting agents, preservatives, and any mixtures or combinations thereof. In one embodiment of the invention, the inventive cleaning composition is essentially free of a biocide (quat) release agents. Biocide release agents which are excluded are salts having a relatively high ionic strength per mole. More specifically, the ionic strength of the one or more salts that make up the biocide release agents used in and/or used in combination with the cleaning composition is about 1×10−2−2 mol/l. In one embodiment, the cleaning composition of the present invention may be essentially free of the following biocide release agents: potassium citrate, sodium citrate, magnesium sulphate, sodium chloride, ammonium chloride, and/or potassium chloride.

Preservatives used in this composition should be suitable for "leave-on" application for the skin based on irritation potential, sensitization potential, and toxicity. In combination with the quaternary amine antimicrobial active, this preservative should demonstrate broad-spectrum protection against fungi. Examples of such preservatives include, but are not limited to, phenoxyethanol, sodium benzoate, potassium sorbate, caprylyl glycol, chlorphenesin, iodopropynyl butylcarbamate (IPBC), gluconolactone, dehydroxyacetic acid, benzyl alcohol, salicylic acid, sorbic acid and any combinations or mixtures thereof. Suitable exemplary preservative compounds are available from Dow under the tradename NEOLONE (e.g., NEOLONE PH 100). Additional exemplary preservative compounds are available from Lonza Co. under the tradenames MIKROKILL, GLYCACIL and GEOGARD (e.g., MIKROKILL COS, GEOGARD ULTRA, GEOGARD 111 A, GEOGARD ECT). The effective pH range for the composition will vary depending on which preservative or combination of preservatives is chosen. In general, the pH range should be about 2 to 10, preferably about 3-8, more preferably 4 to 6.5.

In one embodiment of the invention, nonionic antifungal preservatives, including, but not exclusively limited to, iodopropynyl butylcarbamate, phenoxyethanol, chlorphenesin, and gluconolactone, are preferred to achieve effective mold and bacterial preservation and to stability. For example the antifungal preservatives may comprise about 0.1 to 2% by weight, more preferably 0.1 to 1% by weight, most preferably 0.15 to 0.6% by weight. Salt-based preservatives (e.g., sodium benzoate and potassium sorbate) may also be used in the composition, but may be limited to a smaller amount than other preservatives in the composition to decrease their negative impact on stability and streaking and filming. For example the salt-based preservative may comprise about 0.1 to 1.0% by weight, more preferably 0.1 to 0.8% by weight, most preferably 0.2 to 0.7% by weight. In one embodiment, the ratio of a salt-based antifungal preservative added in addition to the quaternary amine antimicrobial compound should be limited to less than about a 1:2 ratio of salt-based preservative by weight to the total antimicrobial and preservatives by weight (e.g. the ratio of sodium benzoate to the combined weight of quaternary ammonium and iodopropynyl), preferably the ratio is less than 1:3, and more preferably the ratio is less than 1:5.

IV. Suitable Nonwoven Substrates

The formulations may be used in combination with nonwoven substrates to produce pre-moistened wipes. Suitable examples include, but are not limited to, 75-100% by weight of synthetic fibers, including but not limited to, polypropylene (PP), polyethylene terephthalate (PET), polyethyelene (PE), nylon, polyacrylate and any mixtures or combinations thereof. The nonwoven substrates may be made from various processes, including but not limited to, spunlace, needlepunch, airlaid, wetlaid, meltspun or any mixture or combinations thereof. The nonwoven substrates have a basis weight range of 15-75 grams per square meter and thickness of 0.1 mm-1.0 mm. Such nonwoven substrates may be employed as sanitizing or disinfecting wipes. In an embodiment, the cleaning wipes can be provided pre-moistened, or impregnated with cleaning formulation, but generally dry to the touch. Such substrates may be maintained in a sealed container, such as, for example, within a bucket with an attachable lid, sealable plastic pouches or bags, canisters, jars, tubs, and so forth.

In one embodiment of the invention, the 100% synthetic nonwoven substrates having a low denier (e.g. 0.6-2), low basis weight (e.g. 15-75 gsm), low density (e.g. 0.005-0.5 g/cc), and high thickness (e.g. caliper of the dry substrate is about 0.5-6.5 mm at 0.01 psi) provide a combination of effective characteristics that aid release of the quaternary antimicrobial active without the use of release agents (e.g. sodium or potassium chloride, or sodium, potassium, or ammonium citrate, or potassium sulfate, etc.). This construction also yields an absorbent wipe suitable for both sanitizing and cleaning hands as well as cleaning hard surfaces. In a preferred embodiment, the denier of the substrate fibers should be less than 2.0, to less than 1.5, to less than 1.3. The basis weight of the nonwoven is about 15 to 100 gsm, preferably 15 to 75 gsm and most preferably 15 to 50 gsm. The density of the nonwoven substrate of the present invention is generally less than about 0.5 g/cc, preferably less than 0.2 g/cc, typically less than about 0.15 g/cc, and more typically about 0.05 to 0.15 g/cc. For purposes of the present invention, the caliper is defined as the average thickness of the wipe in millimeters (mm), measured under a pressure of about 0.01 psi, when the substrate is in a dry state. The caliper of the nonwoven is about 0.2 to 4 mm, preferably about 0.3 to 2 mm, and most preferably 0.3 to 1 mm.

V. Exemplary Formulations and Test Results

Table 1 sets forth comparative formulations. Example 1 is an exemplary formulation that was prepared according to a working example of the present invention, which included both a glycol ether solvent and a glycol solvent. Example 2 is identical to Example 1, but does not contain the glycol ether solvent. These will be compared to commercially available WET ONES Antibacterial Hand Wipes, which don't contain glycol solvent or glycol ether solvent, and contains a high level of alcohol solvent and salt quat release agent, and a High Residue Control, which contains a glycol ether solvent, a high level of alcohol solvent, and a salt quat release agent.

TABLE 1

Examples 1, 2, and comparison formulae

| | | Weight % (as 100% active) | | | |
|---|---|---|---|---|---|
| Component | Function | Example 1 | Example 2 | WET ONES* | High Residue Control |
| Water | | Balance | Balance | Balance | Balance |
| | | Surfactants | | | |
| Sodium Laureth Sulfate | Anionic Surfactant | 0.02% | 0.02% | | |
| Cocoamido-propyl betaine | Zwitterionic Surfactant | 0.1% | 0.1% | | |
| PEG-60 Lanolin | Nonionic surfactant | | | present | |
| Quaternium-52 | Cationic surfactant | | | present present | |
| PEG-8 Dimethicone | Nonionic surfactant | | | present | |
| Sodium capryl amphopropion-ate | Anionic surfactant | | | present | |
| Lauryl dimethylamine oxide | Nonionic surfactant | | | | 0.16% |
| | | Glycol Solvents | | | |
| Propylene Glycol | Lubricant, emollient | 0.06% | 0.06% | | |
| Diethylene glycol monoethyl ether | Solvent, emollient | 1% | 0% | | |
| Dipropylene glycol n-butyl ether | Solvent | | | | 0.59% |
| | | Other solvents/emollients | | | |
| Ethyl alcohol | Solvent | 0.45% | 0.45% | 9-12%** | |
| Aloe barbedensis Leaf Juice | Emollient | | | present | |
| Isopropanol | Solvent | | | | 3.6% |
| | | Antimicrobials | | | |
| Benzethonium Chloride | Antimicrobial Active | 0.3% | 0.3% | 0.30% | |
| Iodopropynyl butylcarbamate | Preservative | 0.5% | 0.5% | | |
| Potassium sorbate | Preservative | | | Present | |
| Phenoxyethanol | Preservative | | | Present | |
| Methylparaben | Preservative | | | Present | |

TABLE 1-continued

| Examples 1, 2, and comparison formulae | | | | | |
|---|---|---|---|---|---|
| | | Weight % (as 100% active) | | | |
| Component | Function | Example 1 | Example 2 | WET ONES* | High Residue Control |
| Ethylparaben | Preservative | | | Present | |
| Propylparaben | Preservative | | | Present | |
| Alkyl (C12-C18) dimethylbenzyl and dimethyl-ethyl benzyl ammonium chlorides | Antimicrobial active | | | | 0.37% |
| Other ingredients | | | | | |
| Fragrance | Fragrance | 0.1% | 0.1% | Present | 0.15% |
| Disodium EDTA | Stabilizer | | | Present | 0.10% |
| Citric acid | Quat release agent, buffer | | | Present | |
| Potassium citrate | Quat release agent, buffer | | | | 0.10% |

*from ingredient label of Wet Ones Antibacterial Hand Wipes
**from MSDS of WET ONES Antibacterial Hand Wipes Imaging based evaluation of the residue characteristics of Examples 1 and 2 was conducted using black enamel and black ceramic tiles. For example, black enamel tile has a high gloss finish as compared to a more matte finish on the black ceramic tile. Both can be notoriously difficult when attempting to minimize appearance of surface residue in the form of filming and streaking when using various cleaning formulations. The results of Examples 1 and 2 were compared with WET ONES® Antibacterial Hand Wipes. The formulations of Examples 1 and 2 were provided, loaded onto a nonwoven substrate at a loading ratio of 2.5. The loading ratio is the weight ratio of formulation loaded into the wipe per weight of the wipe (i.e., a 2.5 loading ratio means that 2.5 times the weight of the wipe of formulation was loaded into the wipe). For the present invention, the loading ratio may be about 1 to 4, preferably about 1 to 3 and most preferably about 2 to 3.5. The nonwoven substrate used for this testing was a 100% PET spunlace material having a basis weight of 44 gsm, thickness of 0.50 mm and a density of 0.09 g/cc. The WET ONES® Antibacterial Hand Wipes were obtained commercially.

Wipes residue was applied to surfaces by wrapping a 2 ply nonwoven substrate folded around a molded hand-shaped block, and wiping across the test surface using 4 passes, with each cleaning pass covering the entire tile surface. The nonwoven substrates were folded with textured side out—and wiping was conducted using a force of about 2-3 pounds. Once the nonwoven substrates were used to wipe the black enamel or black ceramic tiles, imaging data was obtained therefor (e.g., by digital camera). A gray scale line scan imaging system illuminated the tiles using a line light with a 20 degree angle of incidence was used to obtain images. The images were 8-bit gray scale, resulting in image pixel values from 0 to 255, with 0 corresponding to black (residue free surface) and 255 corresponding to white (high residue). The image exposure (or scan time) was adjusted to achieve a mean gray value in the range of 24-38 for clean black enamel tiles and 42-46 for clean black ceramic tiles. Images were flat fielded using image data from clean tiles to correct for any light variations on test tiles. Image processing software was used to evaluate image pixels for intensity (e.g. gray value, gray value histograms) and variability (e.g. gray value standard deviation). Black enamel and ceramic tiles, respectively, cleaned with isopropyl alcohol and a microfiber cloth provided the control reference for a "clean" tile with no residue. Based on the imaging data a percentage "dirty" value was calculated for each tile and wipe combination. The % Dirty score was calculated on black enamel surfaces using the following equation: % Dirty (enamel)=[(Number of Pixels≥64)×100 /Total Image Pixels]. The pixel intensity of 64 was selected as a threshold value for determining clean vs. dirty areas of the black enamel tiles because it is equivalent to the mean gray pixel value plus three standard deviations for a clean black enamel tile imaged under equivalent conditions. The % Dirty score was calculated on black ceramic surfaces using a similar equation: % Dirty (ceramic)=[(Number of Pixels≥32)×100/Total Image Pixels]. The pixel intensity of 32 was selected as a threshold value for determining clean vs. dirty areas of the black ceramic tiles because it is equivalent to the mean gray pixel value plus three standard deviations for a clean black ceramic tile imaged under equivalent conditions. These % Dirty results for the black enamel tiles are shown in Table 2, below, as well as presented in bar-graph form in FIG. 1. The raw imaging data is shown in Table 4 and FIG. 2.

TABLE 2

| Black Enamel Product Residue Testing Results | | | | |
|---|---|---|---|---|
| Sample ID | Number of Replicates | % Dirty Ave. | Std. Dev. | 80% Confidence Interval |
| Example 1 | 3 | 2.46 | 3.33 | 2.47 |
| Example 2 | 3 | 15.62 | 9.16 | 6.78 |
| Wet Ones ® | 3 | 68.23 | 26.35 | 19.50 |
| High Residue Control | 3 | 92.57 | 8.30 | 7.52 |
| Clean Black Enamel | 2 | 0.74 | 1.08 | 0.80 |

As a comparison of the "% Dirty" results on black enamel surfaces indicate, Example 1, including the glycol ether, was far superior to any of the other examples, with a % Dirty value of 2.46. This is very similar to the % Dirty score (0.74) of the clean control. Example 2, which was identical to Example 1, but without the glycol ether had a % Dirty value of 15.62. For comparison, both of these scores are significantly superior to the scores obtained by WET ONES® Antibacterial Hand Wipes, which was 68.23, and the High Residue Control, at 92.57.

Thus, one can readily appreciate that the inclusion of the preferred glycol ether results in a dramatic reduction in the % Dirty value—e.g., the value of 2.46 is over 6 times less than the % Dirty value for Example 2. This provides evidence that the inclusion of the preferred glycol ether, which would be expected to increase residue, as it is an emollient, surprisingly and unexpectedly results in more than a 6 times reduction in the % Dirty value as compared to a formulation (Example 2) that is otherwise identical, but without the preferred glycol ether.

In addition to the surprisingly excellent reduction in % Dirty values associated with Example 1, Example 2 itself shows results that are also markedly superior as compared WET ONES® Antibacterial Hand Wipes. For example, the % Dirty value of 15.62 is about 4 times better than the % Dirty score achieved by WET ONES® Antibacterial Hand Wipes (i.e., % Dirty value of 68.23). Thus, even formulations including a glycol solvent such as propylene glycol but no glycol ether also showed significantly better residue minimizing characteristics than the residue characteristics of the existing tested formulations.

Figure 2:
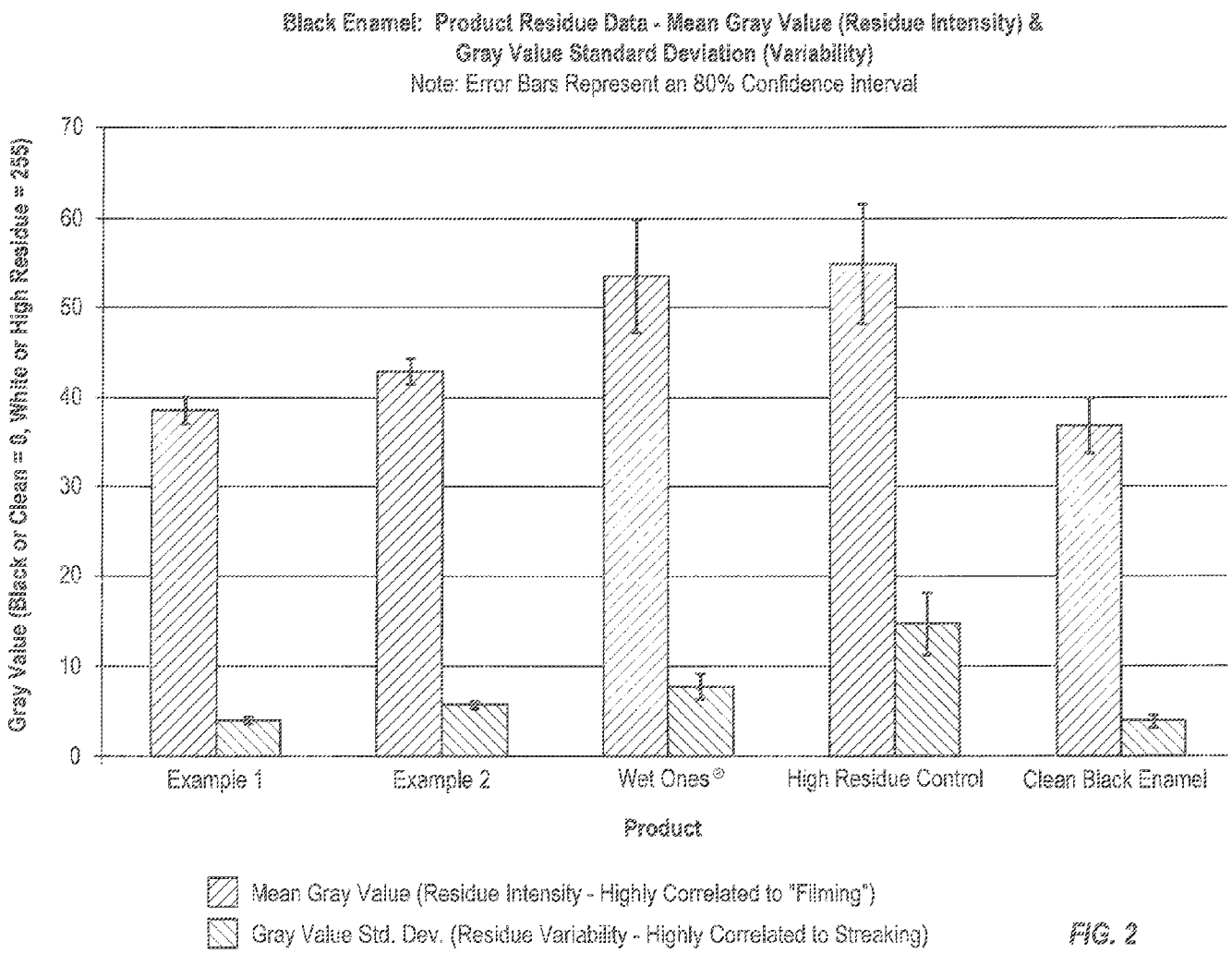
FIG. 2 is a bar chart showing mean gray values (which is highly correlated to filming) and gray value standard deviation values (which is highly correlated to streaking) for the same formulations and black enamel tiles as FIG. 1.

Table 4 below and accompanying FIG. 2 show the raw imaging data used to determine the % Dirty values and other data shown in Table 2 and FIG. 1. For example, mean gray value data was determined based on the imaging data, with a gray-scale value of 0 corresponding to black, and a gray-scale value of 255 corresponding to white (e.g., an 8-bit gray scale). The mean gray values and gray value standard deviation values for each formulation and tile combination are shown in Table 3 and accompanying FIG. 2. It was further observed that the mean gray value scores were highly correlated to filming, and that the gray value standard deviation values were highly correlated to streaking. In other words, those test subjects having relatively higher mean gray values exhibited increased filming, while those test subjects having relatively higher gray value standard deviations exhibited increased streaking.

TABLE 3

Black Enamel Product Residue Testing Results - Raw Imaging Data

| Sample ID | Number of Replicates | Mean Gray Value (Residue Intensity - Highly Correlated to "Filming") | Std Dev. | 80% Confidence Interval | Gray Value Std. Dev. (Residue Variability - Highly Correlated to Streaking) | Std. Dev. | 80% Confidence Interval |
|---|---|---|---|---|---|---|---|
| Example 1 | 3 | 38.51 | 2.12 | 1.57 | 3.90 | 0.49 | 0.36 |
| Example 2 | 3 | 42 80 | 1.92 | 1.42 | 3.63 | 1.47 | 0.35 |
| Wet Ones ® | 3 | 53 45 | 8.52 | 6.31 | 7.67 | 1.9 | 1.41 |
| High Residue Control | 3 | 54.81 | 9.01 | 6.67 | 14.66 | 4.70 | 3.47 |
| Clean Black Enamel | 2 | 36.74 | 4.10 | 3.03 | 3.83 | 0.89 | 0.66 |

Figure 3:
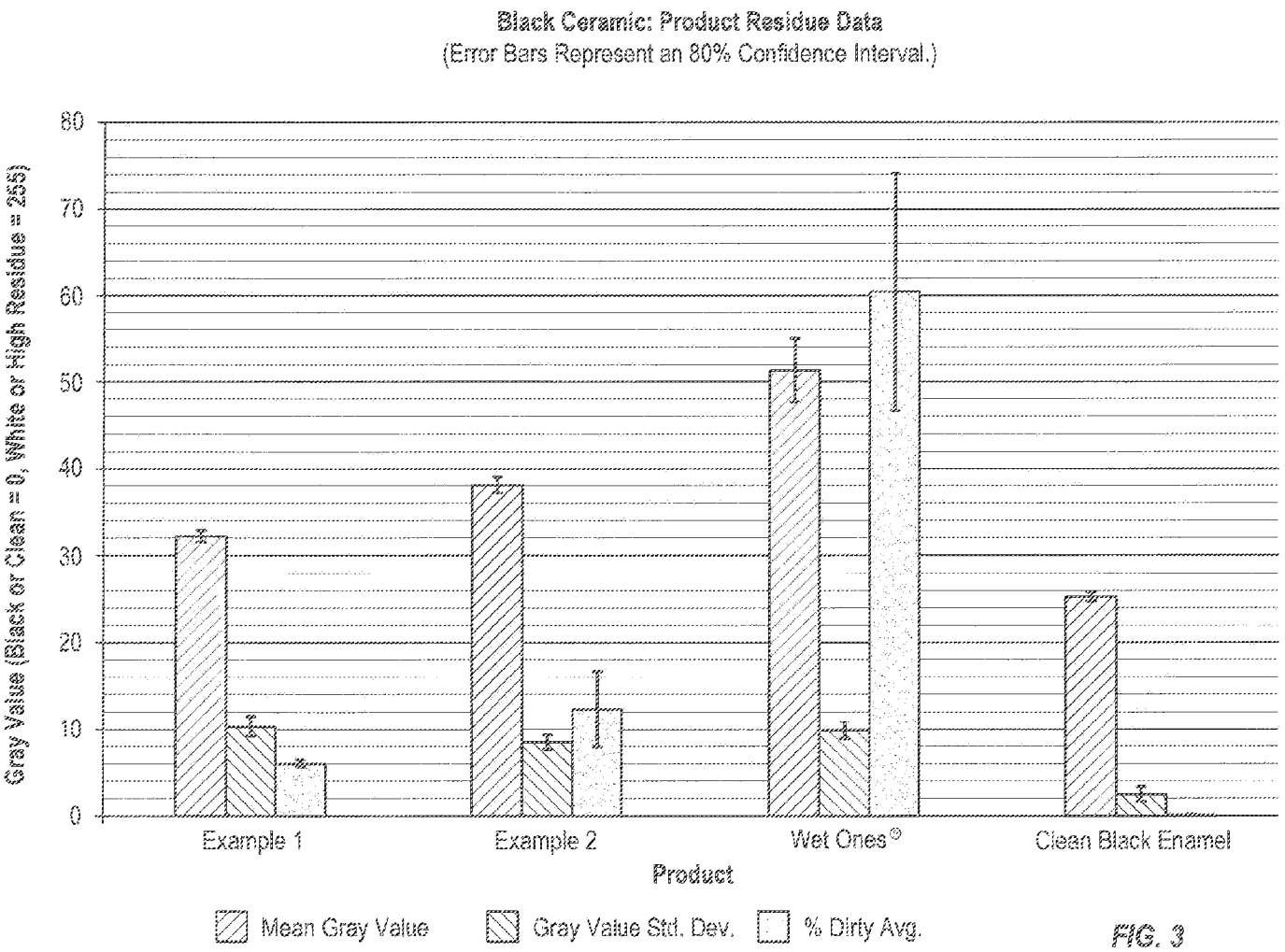
FIG. 3 is a bar chart showing percent dirty scores, mean gray values, and gray value standard deviation values for several formulations tested on black ceramic tiles.

Similar testing as described above with respect to black enamel was also conducted using the same formulations, but on black ceramic tiles. The results, including raw data and determined % Dirty scores, for the black ceramic tiles are shown in Table 4, below, as well as presented in bar-graph form in FIG. 3.

TABLE 4

Black Ceramic - Product Residue Testing-Results

| | | Mean Gray Value | | | Gray Value Std. Dev. | | | % Dirty | | |
|---|---|---|---|---|---|---|---|---|---|---|
| Sample ID | Number of Replicates | Mean Gray Value | Std. Dev. | 80% Confidence Interval | Gray Value Std. Dev. | Std. Dev. | 80% Confidence Interval | % Dirty Avg. | Std Dev. | 80% Confidence Interval |
| Example 1 | 3 | 32.19 | 0.86 | 0.64 | 10.35 | 1.50 | 1.11 | 6.08 | 0.54 | 0.40 |
| Example 2 | 3 | 38.13 | 1.19 | 0.88 | 8.53 | 1 10 | 0.82 | 12.29 | 5.79 | 4.28 |
| Wet Ones ® | 3 | 51.41 | 4.95 | 3.66 | 9.84 | 1.26 | 0.93 | 60.45 | 18.52 | 13.7 |
| Clean Black Enamel | 3 | 25.24 | 0.70 | 0.51 | 2.49 | 1.29 | 0.89 | 0.06 | 0.06 | 0.05 |

As a comparison of the "% Dirty" scores indicate, the Example 1 formulation was better than Example 2, and both were far superior to WET ONES®. Evidence that the inclusion of a glycol ether solvent significantly improves the residue minimizing characteristics of the formulation is found in the comparison of the Mean Gray Value and % Dirty values for Examples 1 and 2. The % Dirty score (6.08) for Example 1 (including the glycol ether solvent) is more than 2 times better than the % Dirty score (12.29) for Example 2 (without the glycol ether solvent).

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A preloaded cleaning and sanitizing wipe comprising:

(A) a nonwoven substrate;

(B) a cleaning composition loaded onto or within said nonwoven substrate, said cleaning composition consisting of;

(a) about 0.001-10.0% by weight of a quaternary ammonium compound; and (b) about 0.05%-4% by weight of an alcohol solvent containing a single hydroxyl group;

(c) about 0.01-10% by weight of a glycol solvent selected from the group consisting of: diethylene glycol, triethylene glycol, propylene glycol, tripropylene glycol, ethylene glycol monomethyl ether, ethylene glycol monoethyl ether, ethylene glycol monopropyl ether, ethylene glycol monobutyl ether, ethylene glycol monophenyl ether, ethylene glycol monobenzyl ether, diethylene glycol monomethyl ether, diethylene glycol monoethyl ether, diethylene glycol mono-n-butyl ether, diethylene glycol monohexyl ether, triethylene glycol monomethyl ether, triethylene glycol monoethyl ether, triethylene glycol monobutyl ether, ethylene glycol dimethyl ether, ethylene glycol diethyl ether, ethylene glycol dibutyl ether and any combinations or mixtures thereof;

(d) about 0.01-10% by weight of one or more anionic surfactants;

(e) optionally, one or more adjuncts selected from the group consisting of: fragrances, perfumes, buffers, builders, stabilizers, defoamers, thickeners, hydrotropes, biocide release agents, water, anti-microbial compounds, enzymes, bleaching agents, cloud point modifiers, nonionic surfactants, amphoteric surfactants and preservatives; and (f) water.

2. A cleaning and sanitizing wipe according to claim 1, wherein said quaternary ammonium compound is selected from the group consisting of: benzethonium chloride, benzalkonium chloride, methylbenzethonium chloride, and any combinations or mixtures thereof.

3. A cleaning and sanitizing wipe according to claim 1, wherein said anionic surfactant is selected from the group consisting of: sulfates, sulfonates, disulfonates, carboxylates, sulfosuccinates, isethionates, glutamates sarcosinates, ether derivatives, and any combinations or mixtures thereof.

4. A cleaning and sanitizing wipe according to claim 1, wherein said cleaning composition comprises an amphoteric surfactant selected from the group consisting of: amine oxides, betaines, imidazoline derivatives, glycinates, propionates, and amino propionic acids, and any combinations, derivatives, or mixtures thereof.

5. A cleaning and sanitizing wipe according to claim 1, wherein said cleaning composition comprises about 0.05-1% by weight of an alcohol solvent containing a single hydroxyl group selected from the group consisting of: ethanol, isopropanol, n-propanol, butanol, and any mixtures or combinations thereof.

6. A cleaning and sanitizing wipe according to claim 1, wherein said glycol solvent is selected from the group consisting of: diethylene glycol, triethylene glycol, propylene glycol, tripropylene glycol, diethylene glycol monomethyl ether, diethylene glycol monoethyl ether, diethylene glycol mono-n-butyl ether and any combinations or mixtures thereof.

7. A cleaning and sanitizing wipe according to claim 1, wherein said cleaning composition comprises a nonionic surfactant selected from the group consisting of: ethoxylates, propoxylates, glycosides, esters, amides, and any combinations or mixtures thereof.

8. A cleaning and sanitizing wipe according to claim 1, wherein said cleaning composition contains a preservative is selected from the group consisting of: iodopropynyl butylcarbamate, phenoxyethanol, chlorphenesin, gluconolactone and any mixtures or combinations thereof.

9. A cleaning and sanitizing wipe comprising:

(A) a nonwoven substrate;

(B) a cleaning composition loaded onto or within said nonwoven substrate, said cleaning composition consisting of;

(a) about 0.001-10% by weight of an antimicrobial compound comprising a quaternary ammonium compound;

(b) about 0.05%-4% by weight of an alcohol solvent containing a single hydroxyl group;

(c) a preservative selected from the group consisting of: iodopropynyl butylcarbamate, phenoxyethanol, chlorphenesin, gluconolactone and any mixtures or combinations thereof;

(d) about 0.01-10% of a glycol ether solvent;

(e) an anionic surfactant;

(f) optionally, one or more adjuncts selected from the group consisting of: fragrances, perfumes, buffers, builders, stabilizers, defoamers, thickeners, hydrotropes, biocide release agents, water, anti-microbial compounds, enzymes, bleaching agents, cloud point modifiers, nonionic surfactants, and amphoteric surfactants; and (g) water.

10. A cleaning and sanitizing wipe according to claim 9, wherein said quaternary ammonium compound is selected from the group consisting of: benzethonium chloride, benzalkonium chloride and any combinations or mixtures thereof.

11. A cleaning and sanitizing wipe according to claim 9, wherein said anionic surfactant is selected from the group consisting of: sulfates, sulfonates, disulfonates, carboxylates, sulfosuccinates, isethionates, glutamates, sarcosinates, and any combinations or mixtures thereof.

12. A cleaning and sanitizing wipe according to claim 9, wherein said anionic surfactant is selected from the group consisting of: sodium lauryl sulfate, ammonium lauryl sulfate, sodium laureth sulfate, ammonium laureth sulfate, sodium coco-sulfate, ammonium cocoyl isethionate, sodium cocoyl isethionate, disodium cocoyl glutamate, sodium lauryl glucose carboxylate, sodium dodecyl sulfate, sodium lauryl ether sulfate, sodium myreth sulfate, and any combinations or mixtures thereof.

13. A cleaning and sanitizing wipe according to claim 9, wherein said cleaning composition comprises an amphoteric surfactant selected from the group consisting of: amine oxides, betaines, imidazoline derivatives, glycinates, propionates, amino propionic acids, and any combinations or mixtures thereof.

14. A cleaning and sanitizing wipe according to claim 9, wherein said glycol ether solvent is selected from the group consisting of: diethylene glycol monomethyl ether, diethylene glycol monoethyl ether, diethylene glycol mono-n-butyl ether and any combinations or mixtures thereof.

15. A cleaning and sanitizing wipe according to claim 9, wherein said an anionic surfactant is selected from the group consisting of: sulfates, sulfonates, disulfonates, carboxylates, sulfosuccinates, isethionates, glutamates sarcosinates, ether derivatives, and any combinations or mixtures thereof.

16. A method of using a cleaning and sanitizing wipe to clean skin and a hard surface comprising the steps of:

(A) providing a user with a pre-loaded nonwoven substrate loaded with a cleaning composition consisting of:

(a) about 0.05-0.5% by weight of a quaternary ammonium compound;

(b) about 0.05-1% by weight of an alcohol solvent;

(c) a preservative;

(d) about 0.05-5% of one or more glycol solvents;

(e) optionally, one or more adjuncts selected from the group consisting of: fragrances, perfumes, buffers, builders, stabilizers, defoamers, thickeners, hydrotropes, biocide release agents, water, anti-microbial compounds, enzymes, bleaching agents, cloud point modifiers, nonionic surfactants, anionic surfactants and amphoteric surfactants; and (e) water;

(B) contacting the skin with the pre-loaded substrate to sanitize the skin;

(C) allowing the sanitized area of the skin to dry; and (D) wiping one or more hard surfaces with the pre-loaded substrate.

17. The method according to claim 16, wherein said quaternary ammonium compound is selected from the group consisting of: benzethonium chloride, benzalkonium chloride and any combinations or mixtures thereof.

18. The method according to claim 16, wherein said glycol solvent is selected from the group consisting of: diethylene glycol, triethylene glycol, propylene glycol, tripropylene glycol, diethylene glycol monomethyl ether, diethylene glycol monoethyl ether, diethylene glycol mono-n-butyl ether and any combinations or mixtures thereof.

19. The method according to claim 16, wherein said preservative is selected from the group consisting of: iodopropynyl butylcarbamate, phenoxyethanol, chlorphenesin, gluconolactone and any mixtures or combinations thereof.

* * * * *